US007963208B2

(12) United States Patent
Terasaki

(10) Patent No.: US 7,963,208 B2
(45) Date of Patent: Jun. 21, 2011

(54) MOUNTING MECHANISM FOR A POSITION-DETECTING SENSOR

(75) Inventor: Atsushi Terasaki, Kasukabe (JP)

(73) Assignee: SMC Kabushiki Kaisha, Tokyo (JP)

( * ) Notice: Subject to any disclaimer, the term of this patent is extended or adjusted under 35 U.S.C. 154(b) by 386 days.

(21) Appl. No.: 12/147,993

(22) Filed: Jun. 27, 2008

(65) Prior Publication Data

US 2009/0025551 A1 Jan. 29, 2009

(30) Foreign Application Priority Data

Jul. 25, 2007 (JP) ..... 2007-193393

(51) Int. Cl.
*F01B 31/12* (2006.01)

(52) U.S. Cl. ..... 92/5 R

(58) Field of Classification Search ..... 92/5 R, 92/5 A

See application file for complete search history.

(56) References Cited

U.S. PATENT DOCUMENTS 7,250,753 B2 7/2007 Terasaki

FOREIGN PATENT DOCUMENTS

| | | |
|---|---|---|
| DE | 9414869 U1 | 12/1994 |
| DE | 60202051 T2 | 11/2005 |
| EP | 1366301 B1 | 11/2004 |
| JP | 61-161402 | 10/1986 |
| JP | 61-193204 | 12/1986 |
| JP | 63-119911 | 8/1988 |
| JP | 3-8846 | 1/1991 |
| JP | 3-28401 | 3/1991 |
| JP | 3-67705 | 7/1991 |
| JP | 5-52310 | 7/1993 |
| JP | 7-270196 | 10/1995 |
| JP | 8-9602 | 3/1996 |
| JP | 11-117913 | 4/1999 |
| JP | 2000-170714 | 6/2000 |
| JP | 2001-182714 | 7/2001 |
| JP | 2005-009606 | 1/2005 |

OTHER PUBLICATIONS

U.S. Appl. No. 12/331,871, filed Dec. 10, 2008, Terasaki.
Notice of decision for grant dated Nov. 16, 2010 issued over the corresponding Korean Patent Application No. 10-2008-0072984 with English translation.

*Primary Examiner* — F. Daniel Lopez
(74) *Attorney, Agent, or Firm* — Oblon, Spivak, McClelland, Maier & Neustadt, L.L.P.

(57) ABSTRACT

A position-detecting sensor to which a mounting mechanism for a position-detecting sensor is applied is equipped with a holder capable of accommodating a sensor element in which a magnetic sensor or the like is disposed, and includes a flange on a lower end of the holder, which is inserted through a sensor mounting groove of a cylinder apparatus. The flange is formed in a plate shape, having a narrow portion and a widened portion that differ in width dimension. After insertion thereof through the sensor mounting groove such that side surfaces of the narrow portion are made parallel with the sensor mounting groove, the holder is turned, whereby the widened portion engages within and is retained respectively by a pair of recess portions in the sensor mounting groove.

4 Claims, 13 Drawing Sheets

MOUNTING MECHANISM FOR A POSITION-DETECTING SENSOR

BACKGROUND OF THE INVENTION

1. Field of the Invention

The present invention relates to a mounting mechanism for a position-detecting sensor, which is used for mounting onto an actuator a sensor capable of detecting a displacement position of a displacement body in an actuator or the like.

2. Description of the Related Art

Heretofore, a position-detecting sensor has been used in order to detect the displacement position of a piston in an actuator or the like. As disclosed in Japanese Laid-Open Utility Model Publication No. 3-008846, the present applicant has proposed a magnetic proximity switch functioning as the aforementioned positioning detecting sensor and including a mounting tool, which is capable of mounting the magnetic proximity switch with respect to a cylinder tube. Such a magnetic proximity switch is installed through the mounting tool onto an outer circumference of a cylindrically shaped cylinder tube, wherein the cylinder tube is retained in a supporting portion of the mounting tool. In addition, by fastening a fastening member that extends from an end of the supporting portion through a mounting screw, the magnetic proximity switch together with the fastening member is affixed integrally with respect to the cylinder tube.

SUMMARY OF THE INVENTION

A general object of the present invention is to provide a mounting mechanism for a position-detecting sensor, having a simple structure, which is capable of fixing the position-detecting sensor easily and reliably with respect to an actuator.

In order to achieve the object described above, in the present invention, the mounting mechanism for a position-detecting sensor serves to mount the position-detecting sensor, which enables detection of a position of a displacement body within an actuator, into a groove provided in a side surface of the actuator, and wherein the mounting mechanism includes:

a detector for detecting the displacement body, and a holder having an accommodating section for accommodating the detector therein, and an engagement section adjacent to the accommodating section and which is inserted into the groove and retained thereby, wherein the engagement section is capable of being switched between a retained state in which the holder is retained with respect to the groove and a non-retained state.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
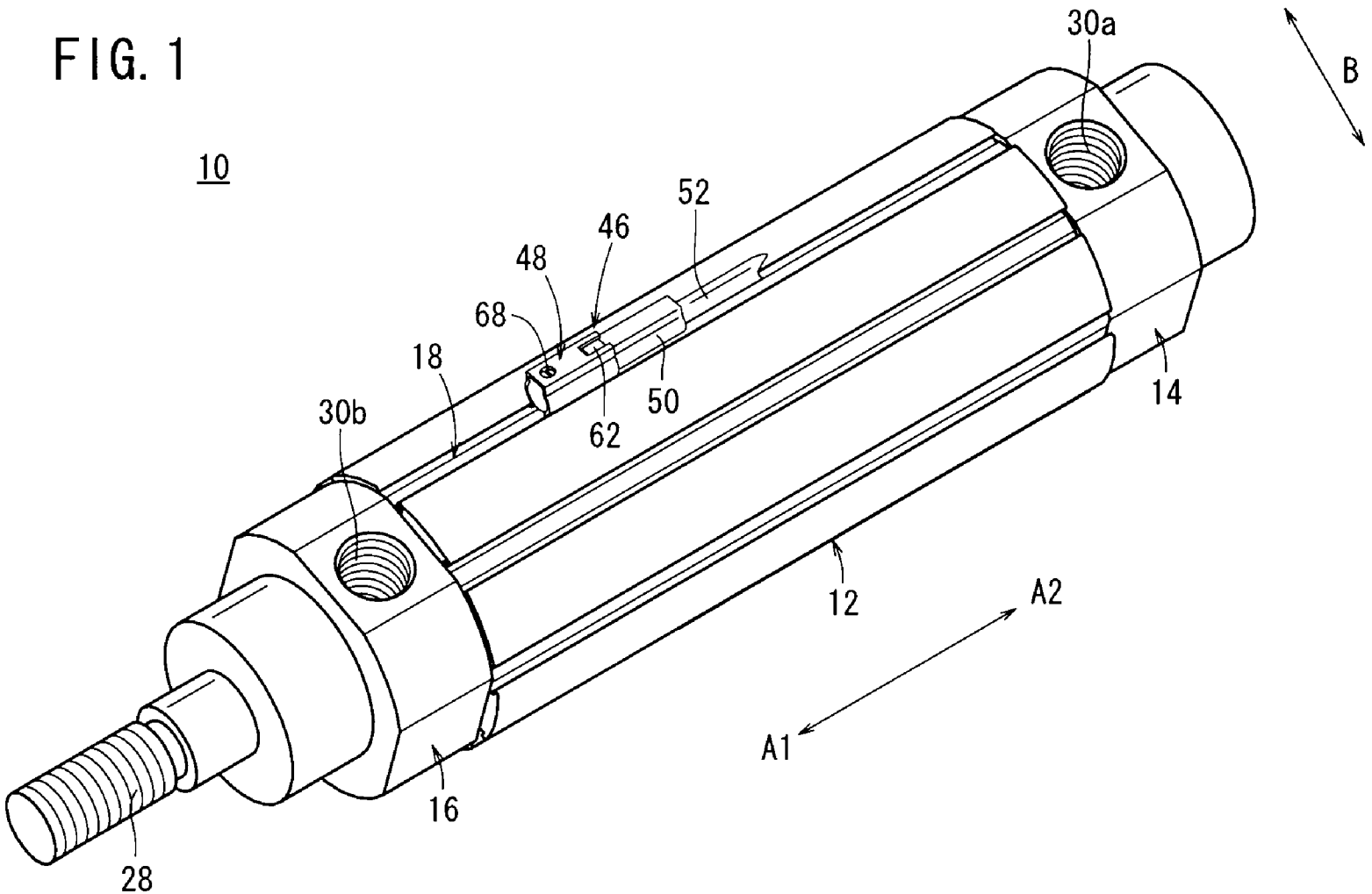
FIG. 1 is an overall perspective view showing a cylinder apparatus on which a position-detecting sensor is installed through a mounting mechanism for a position-detecting sensor according to a first embodiment of the present invention.

A case in which a position-detecting sensor is attached to a cylinder apparatus through application of the mounting mechanism for a position-detecting sensor shall be described. In FIG. 1, reference numeral 10 indicates a cylinder apparatus on which a position-detecting sensor according to a first embodiment of the present invention is installed.

Figure 2:
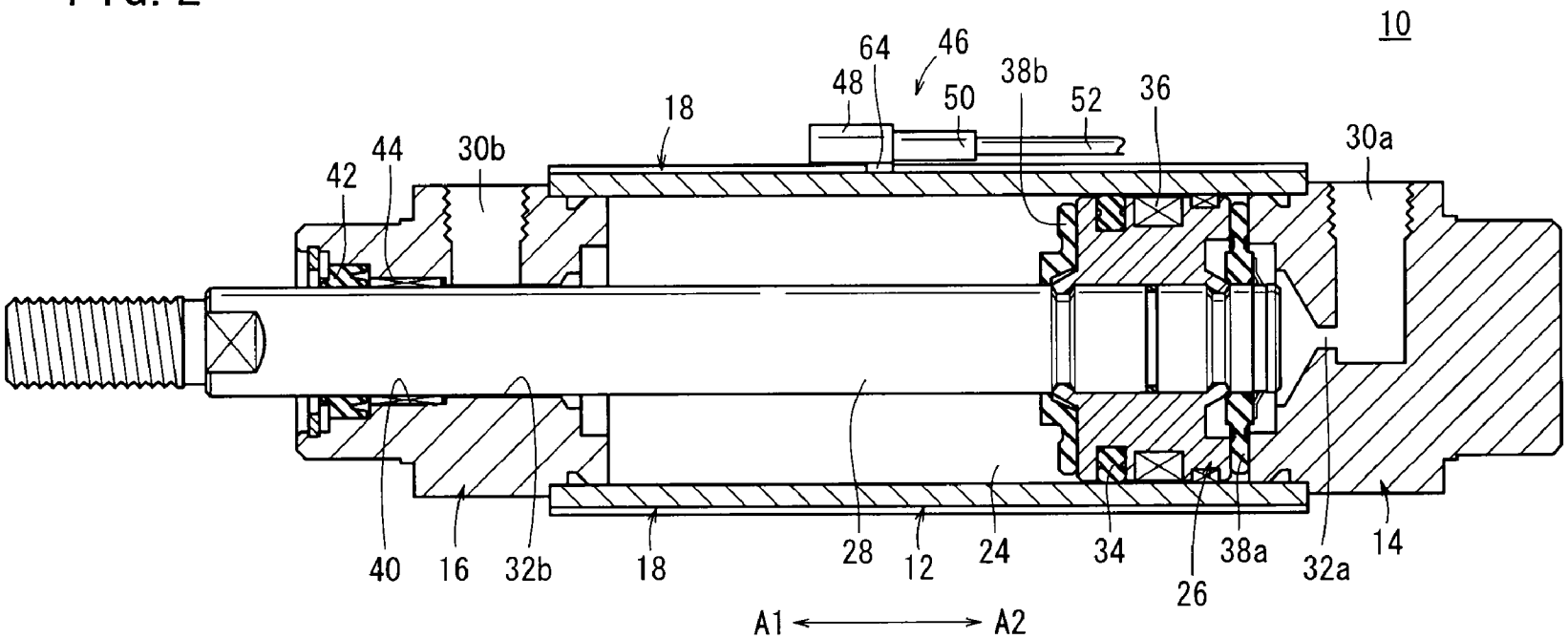
FIG. 2 is an overall vertical cross sectional view of the cylinder apparatus shown in FIG. 1.

The cylinder apparatus (actuator) 10, as shown in FIGS. 1 and 2, includes a cylinder tube 12 formed with a cylindrical shape, a head cover 14 fixedly mounted on one end of the cylinder tube 12, and a rod cover 16 fitted to the other end of the cylinder tube 12.

A plurality of (for instance, eight) sensor mounting grooves (groove portions) 18 separated at equally spaced distances along the circumferential direction thereof are provided on the outer circumferential surface of the cylinder tube 12. The sensor mounting grooves 18 extend along the axial direction of the cylinder tube 12 (in the directions of arrows A1 and A2), and further, penetrate through both end parts of the cylinder tube 12.

Figure 3:
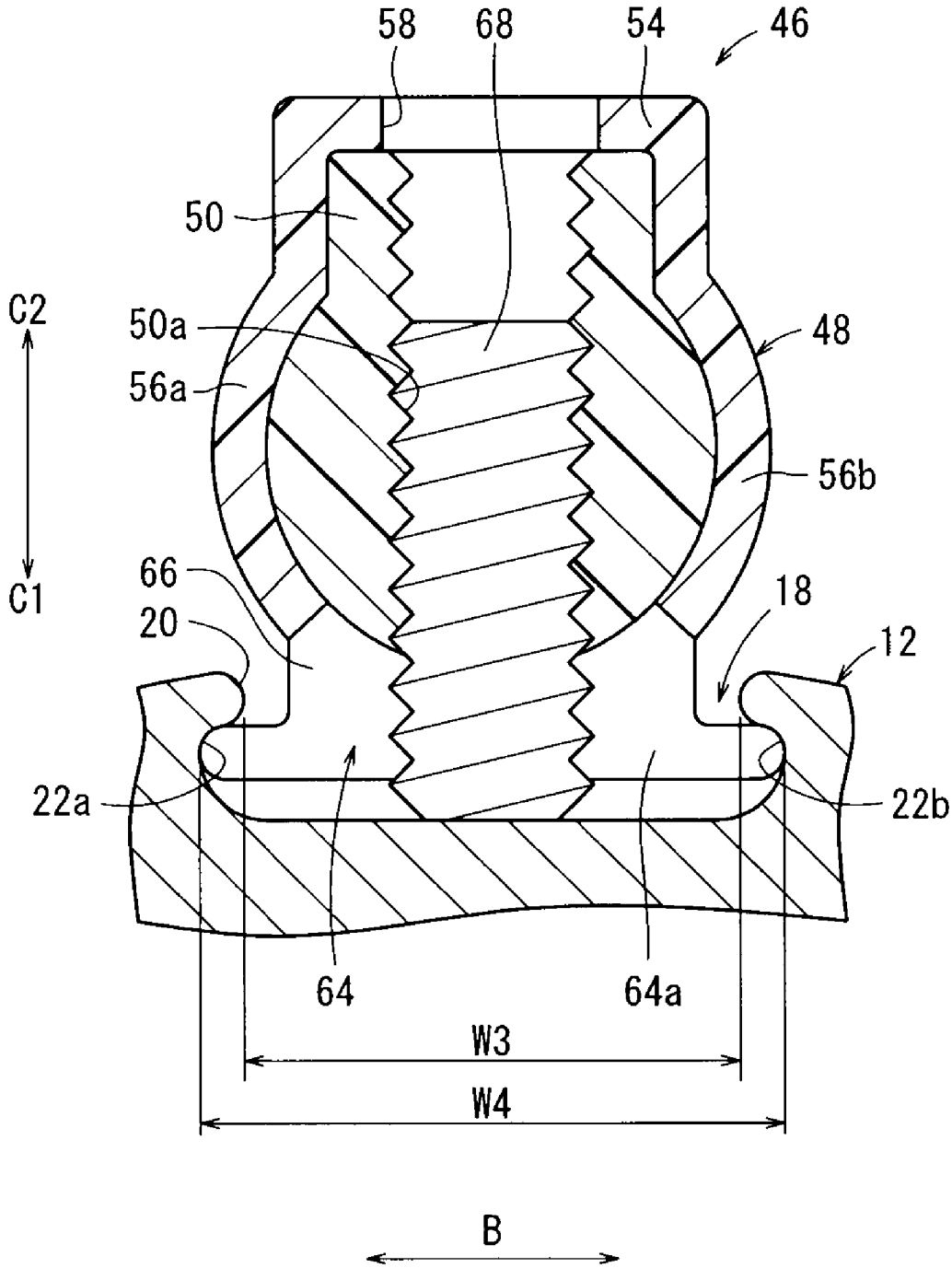
FIG. 3 is a vertical cross sectional view showing a condition in which the position-detecting sensor is installed in a sensor mounting groove of the cylinder apparatus of FIG. 1.

As shown in FIG. 3, each of the sensor mounting grooves 18 is recessed in cross section at a predetermined depth with respect to the outer circumferential surface of the cylinder tube 12. The sensor mounting groove 18 has an opening 20 which opens toward the outer circumferential side of the cylinder tube 12, and recess portions 22*a*, 22*b* that widen in a width direction (the direction of the arrow B) perpendicular to the sensor mounting groove 18 (extending in the directions of arrows A1 and A2) about the opening 20. The end parts, which are separated farthest from the opening 20 of the recess portions 22*a*, 22*b*, are formed to be semicircular in cross section. That is, in the sensor mounting groove 18, the respective recess portions 22*a*, 22*b* are formed at both sides with widthwise expanded symmetrical cross sectional shapes about the center of the opening 20.

On the other hand, as shown in FIG. 2, a cylinder chamber 24 is formed in the interior of the cylinder tube 12, which is closed on respective ends thereof by the head cover 14 and the rod cover 16. A piston (displacement body) 26 is disposed displaceably inside the cylinder chamber 24, together with a shaft shaped piston rod 28, which is connected at one end to a central portion of the piston 26.

Pressure fluid inlet/outlet ports 30*a*, 30*b* through which a pressure fluid is supplied and discharged are disposed respectively in the head cover 14 and the rod cover 16. The pressure fluid inlet/outlet ports 30*a*, 30*b* communicate respectively with the cylinder chamber 24 through communication passages 32*a*, 32*b*.

A piston packing 34 is installed through an annular groove on the outer circumferential surface of the piston 26 and, at a location proximate to the piston packing 34, a magnet 36 also is installed in the piston 26 via an annular groove so as to surround the piston 26.

Further, on both end surfaces of the piston 26, damper members 38*a*, 38*b* formed from an elastic material are disposed respectively via the piston rod 28, so that when the piston 26 is displaced, shocks are absorbed by abutment of the damper members 38*a*, 38*b* against the head cover 14 and the rod cover 16.

A rod hole 40 through which the piston rod 28 is inserted is formed in the rod cover 16. A rod packing 42 and a bush 44 are installed through annular grooves on an inner portion of the rod cover 16. In addition, as a result of sliding contact between the rod packing 42 and bush 44 and the outer circumferential surface of the piston rod 28, airtightness within the cylinder chamber 24 is maintained while the piston rod 28 is supported displaceably for movement along the axial direction (the direction of arrows A1 and A2).

Next, a description shall be given concerning a position-detecting sensor 46, which is installed in the sensor mounting groove 18 of the aforementioned cylinder apparatus 10.

The position-detecting sensor 46 includes a holder 48, which is formed in a hollow shape, for example, from a metal material or a resin material, a sensor element (detector) 50 installed inside the holder 48, and a lead wire 52 connected to an end of the sensor element 50.

As shown in FIGS. 3 to 6, the holder 48 is formed from a tubular body having a cross sectional shape made up from the combination of a projecting part 54 and a pair of bulging portions 56*a*, 56*b*. The projecting part 54 is positioned upwardly at a given distance above the sensor mounting groove 18, and the bulging portions 56*a*, 56*b* are positioned downwardly from the projecting part 54 toward the sensor mounting groove 18 side of the holder 48 (see FIG. 3).

The projecting part 54 is formed in a U-shape in cross section that opens toward the side of the bulging portions 56*a*, 56*b* (the direction of the arrow C1 in FIG. 3). The upper portion of the projecting part 54 is formed with a flat shape, and a hole 58 is formed in the upper portion on one end side along a longitudinal direction of the holder 48, whereas a rectangular-shaped cutout 60 is formed on the other end side thereof. The cutout 60 is cut at a predetermined length from the other end of the holder 48 toward the one end side thereof. When the sensor element 50 is inserted into the holder 48, the cutout 60 functions as a window portion toward which a light emissive element 62 of the sensor element 50 faces.

The pair of bulging portions 56*a*, 56*b* are adjoined respectively to both sides of the projecting part 54, extending in a direction (the direction of the arrow C1) separating from the projecting part 54, and bulging with circular arcuate shapes in cross section so as to expand widthwise on outer sides thereof. That is, the pair of bulging portions 56*a*, 56*b* have semicircular cross sectional shapes, which bulge outwardly in directions separating mutually from each other.

Figure 5:
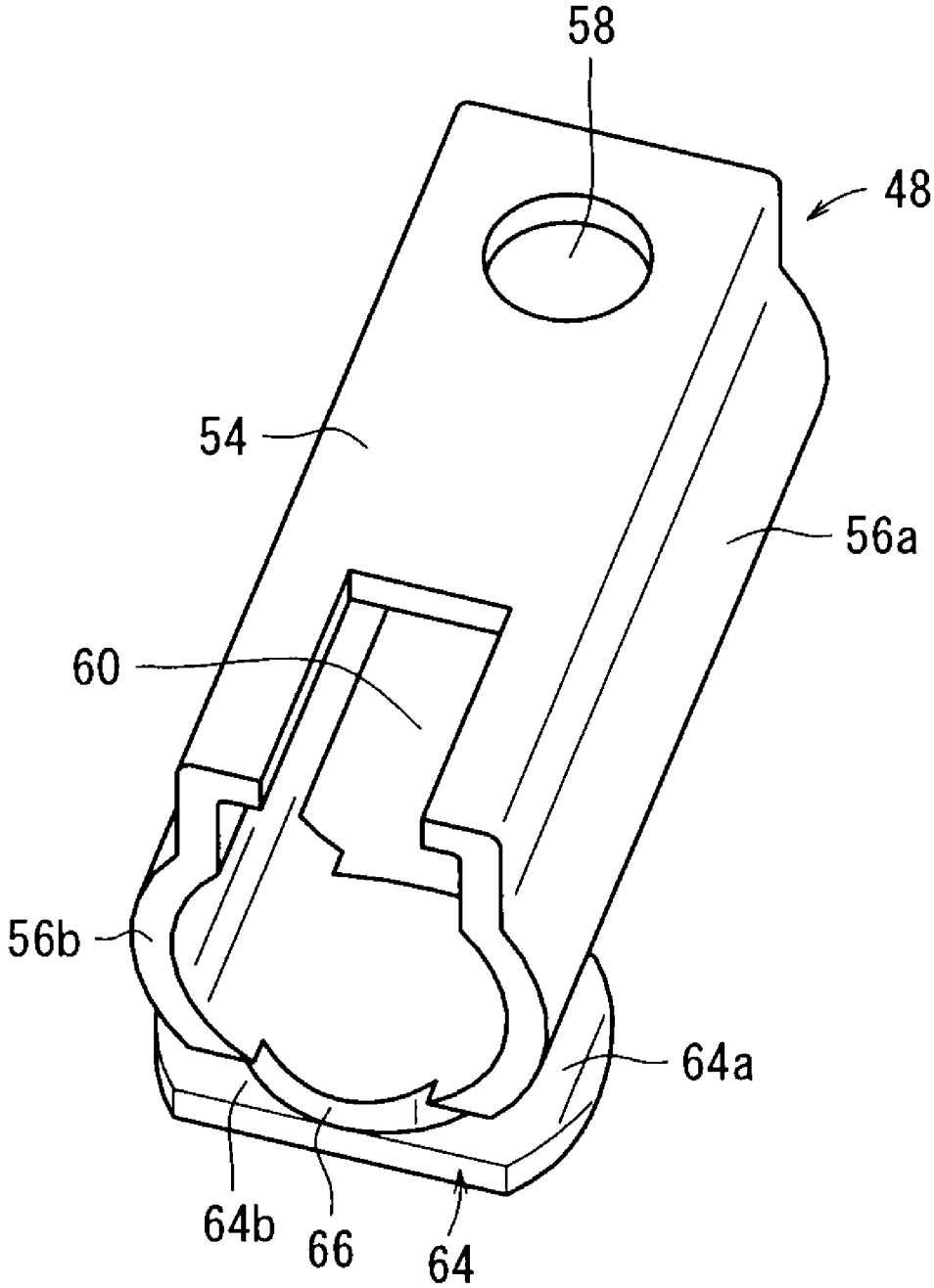
FIG. 5 is a perspective view of a holder making up the position-detecting sensor of FIG. 1.
Figure 6:
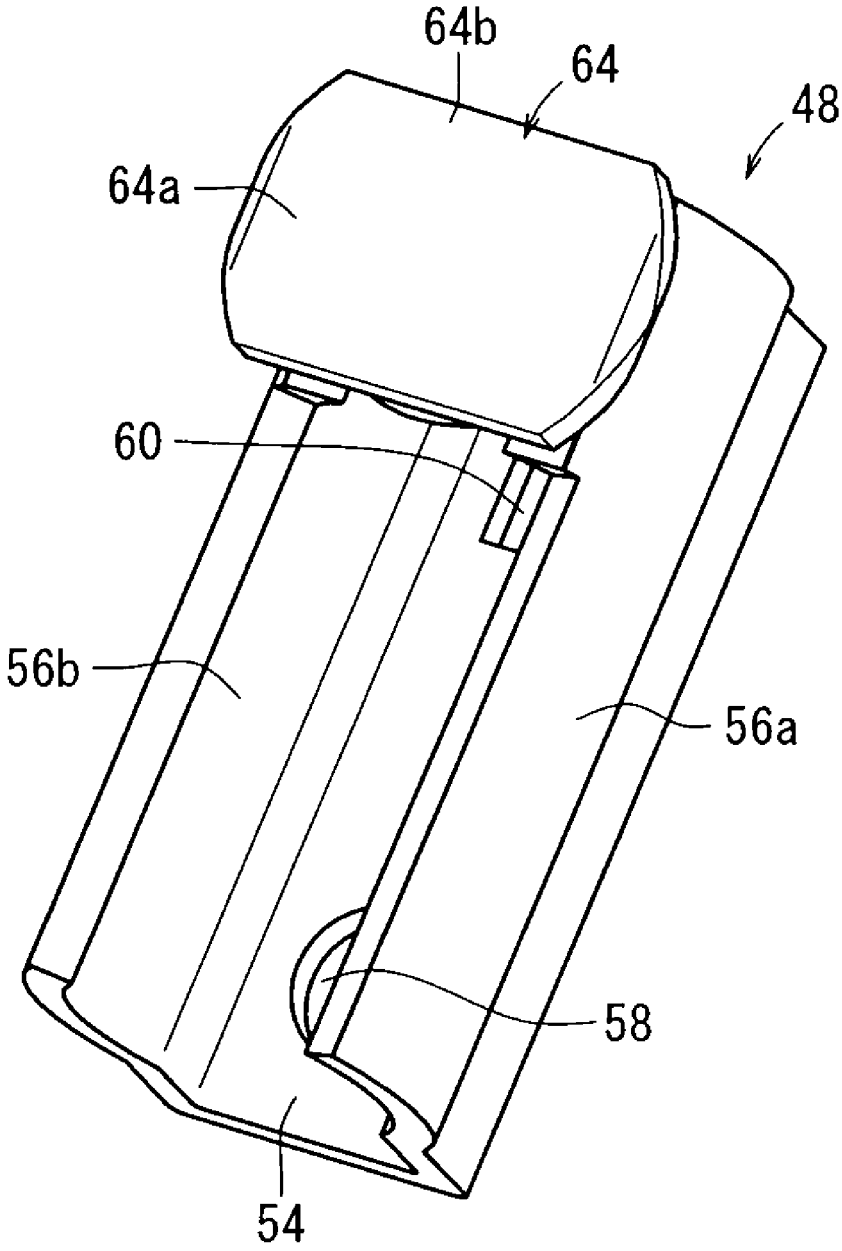
FIG. 6 is a perspective view, as seen from another direction, of the holder of FIG. 5.

Further, on the other end of the holder 48 having the cutout 60 therein, a roughly rectangular-shaped flange (engagement section) 64 is disposed, connecting the pair of bulging portions 56*a*, 56*b*. As shown in FIGS. 5 and 6, the flange 64 is disposed at a position confronting the projecting part 54 and is located between the bulging portions 56*a*, 56*b* in the holder 48. The flange 64 serves to retain the holder 48 by insertion into the sensor mounting groove 18.

More specifically, the flange 64 functions as a mounting mechanism for the position-detecting sensor 46, which is capable of mounting the position-detecting sensor 46 with respect to the sensor mounting grooves 18 of the cylinder apparatus 10.

The flange 64 is formed in a plate shape, having a substantially equal plate thickness corresponding to the depth of the sensor mounting groove 18, and is disposed on the holder 48 through a joining section 66 to lower ends of the opened bulging portions 56*a*, 56*b*. That is, a portion of the bulging portions 56*a*, 56*b* that open in a direction (the direction of the arrow C1) away from the projecting part 54 is blocked or obstructed by the joining section 66 (see FIG. 4) and the flange 64.

Figure 4:
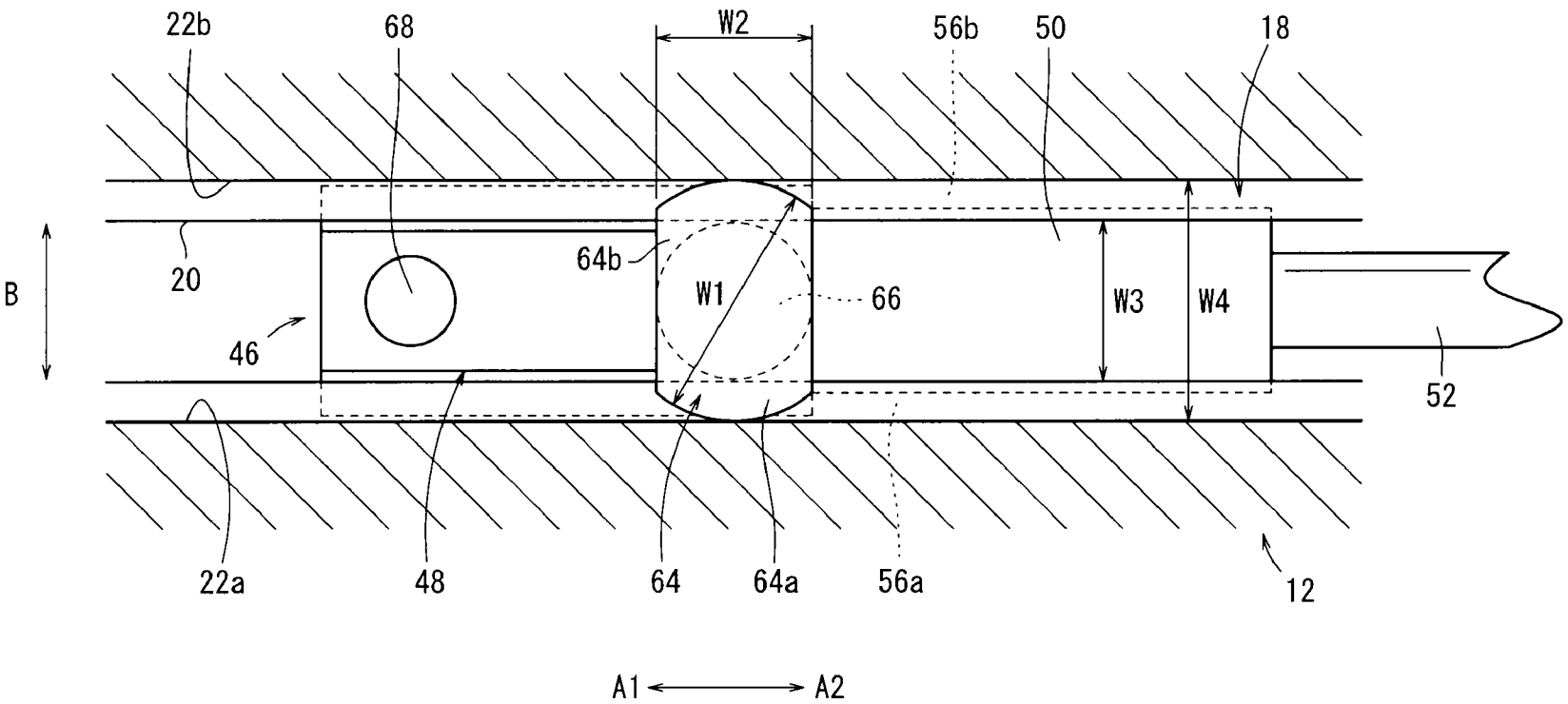
FIG. 4 is a plan view as observed from a side of the sensor mounting groove of the position-detecting sensor shown in FIG. 3.

As shown in FIG. 4, on the flange 64, a width dimension W1, which is formed in a direction transverse to the axial line of the holder 48 (i.e., in the direction of the arrow B), is formed to be greater than a width dimension W2 thereof along the axial direction of the holder 48 (W1>W2), and ends of a widened portion 64*a* thereof set by the width dimension W1 are formed so as to bulge in circular arcuate shapes. The widened portion 64*a* is formed with a shape that is widened just slightly with respect to the projecting part 54 and the bulging portions 56*a*, 56*b*. On the other hand, a narrow portion 64*b*, which is set at a width dimension W2 along the axial direction (the direction of arrows A1 and A2) of the holder 48, is formed with a substantially constant width.

Further, the joining section 66 is formed with a substantially circular shape in cross section, wherein the diameter thereof is set to be smaller than the width dimension W3 (see FIG. 3) of the opening 20 in the sensor mounting groove 18, and is inserted into the opening 20.

The sensor element 50 includes a magnetic sensor (not shown), which is capable of detecting the position of the piston 26 in the cylinder apparatus 10, a light emissive element 62 that emits light when the piston 26 is detected by the magnetic sensor, and a non-illustrated substrate on which the magnetic sensor and the light emissive element 62 are disposed. A lead wire 52 is electrically connected to the substrate.

Additionally, magnetism from a magnet 36 installed in the piston 26 is detected by the magnetic sensor, and by outputting a signal to an unillustrated controller or the like through the lead wire 52, the position of the piston 26 is detected, which can be confirmed from the outside by illumination of the light emissive element 62.

The sensor element 50 is integrally covered by a thermoplastic resin material in a state including, for example, the magnetic sensor, the substrate and the like, and, after being inserted into the holder 48, is once again covered by a resin material.

Owing thereto, when the sensor element 50 is installed inside the holder 48, by engagement of the sensor element 50 with respect to the projecting part 54, the sensor element 50 is not rotationally displaced inside the holder 48, and a condition results in which relative displacement in the rotational direction is regulated.

Further, a fixing screw 68 is screw-engaged in the other end of the sensor element 50 on a side opposite to the end on which the lead wire 52 is connected. The fixing screw 68 is screw-engaged in a screw hole 50*a* (see FIG. 3), which penetrates therethrough perpendicular to the longitudinal direction of the sensor element 50, wherein by rotation thereof, the fixing screw 68 is disposed while being displaceable along an axial direction. Further, when the sensor element 50 is installed in the holder 48, the fixing screw 68 is arranged in a position facing the hole 58 of the holder 48. On the other hand, through positioning of the light emissive element 62 constituting the sensor element 50 so as to face toward the cutout 60 of the holder 48, when the light emissive element 62 is illuminated, the illuminated condition thereof can be confirmed visually from the outside through the cutout 60.

That is, the sensor element 50 is installed into the holder 48 so that the fixing screw 68 and the screw hole 50*a* are arranged on the one end side (in the direction of the arrow A1) of the holder 48 which includes the hole 58 therein, and so that the light emissive element 62 is positioned on the other end side (in the direction of the arrow A2) of the holder 48 which includes the cutout 60 therein.

The cylinder apparatus 10 to which the position-detecting sensor 46 is attached through application of the mounting mechanism according to the first embodiment of the present invention is basically constructed as described above. Next, a case in which the position-detecting sensor 46 is mounted with respect to the cylinder apparatus 10 shall be described. When mounting of the position-detecting sensor 46 is carried out with respect to the sensor mounting groove 18 of the cylinder apparatus 10, a condition is set up in which the sensor element 50 and the holder 48 constituting the position-detecting sensor 46 are separated from each other beforehand.

First the holder 48 of the position-detecting sensor 46 is gripped and is placed in proximity to the sensor mounting groove 18 so that the axial direction of the holder 48 is perpendicular with respect to the sensor mounting groove 18. In this case, the side surfaces of the narrow portion 64*b* of the flange 64 of the holder 48 are in a state of being substantially parallel with the sensor mounting groove 18. Stated otherwise, the arcuate ends of the widened portion 64*a* are arranged and oriented in the extending direction (the direction of arrows A1 and A2) of the sensor mounting groove 18.

Figure 7A:
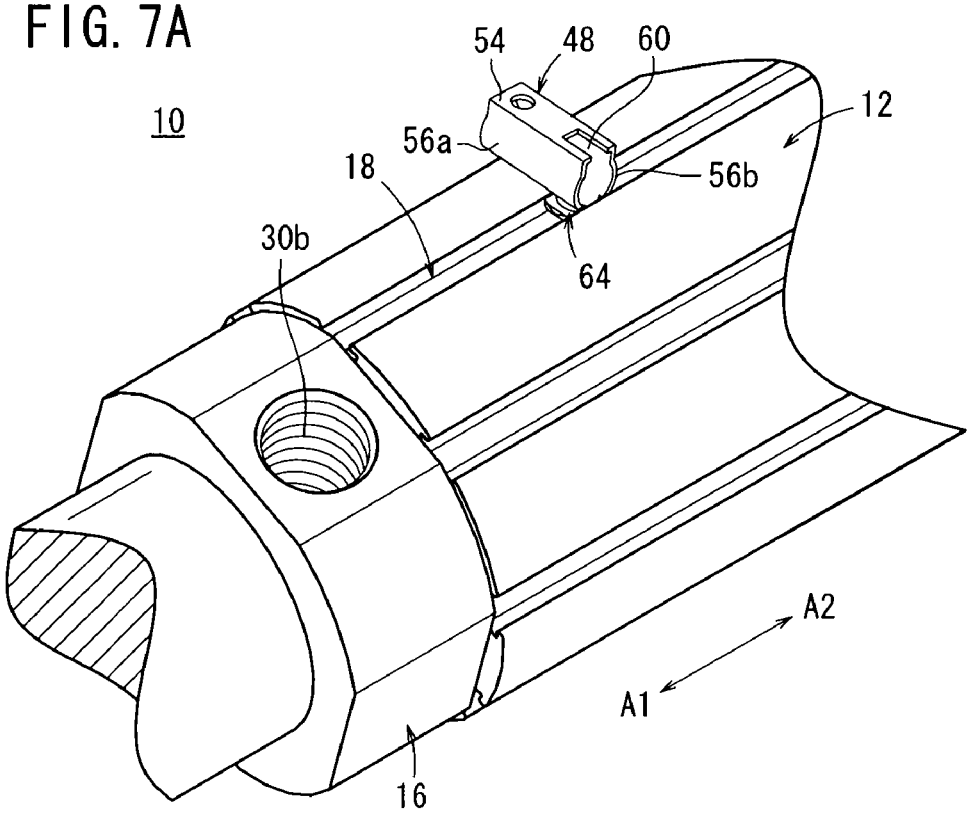
FIG. 7A is an enlarged perspective view of an inserted state in the sensor mounting groove of a flange of the holder of FIG. 5.

In addition, the flange 64 of the holder 48 is inserted from above into the sensor mounting groove 18 and is arranged at a desired position along the sensor mounting groove 18 suitable for detecting the position of the piston 26 (see FIG. 7A). At this time, the narrow portion 64*b* of the flange 64 is in a substantially parallel state with respect to the extending direction (the direction of arrows A1 and A2) of the sensor mounting groove 18, and since the width dimension W2 of the narrow portion 64*b* is smaller than the width dimension W4 of the opening (W2<W4), the flange 64 can be inserted into the sensor mounting groove 18 through the opening 20 thereof.

Moreover, at this time, a state results in which clearances of a predetermined interval are provided between the narrow portion 64*b* of the flange 64 and the recess portions 22*a*, 22*b* in the sensor mounting groove 18.

Figure 7B:
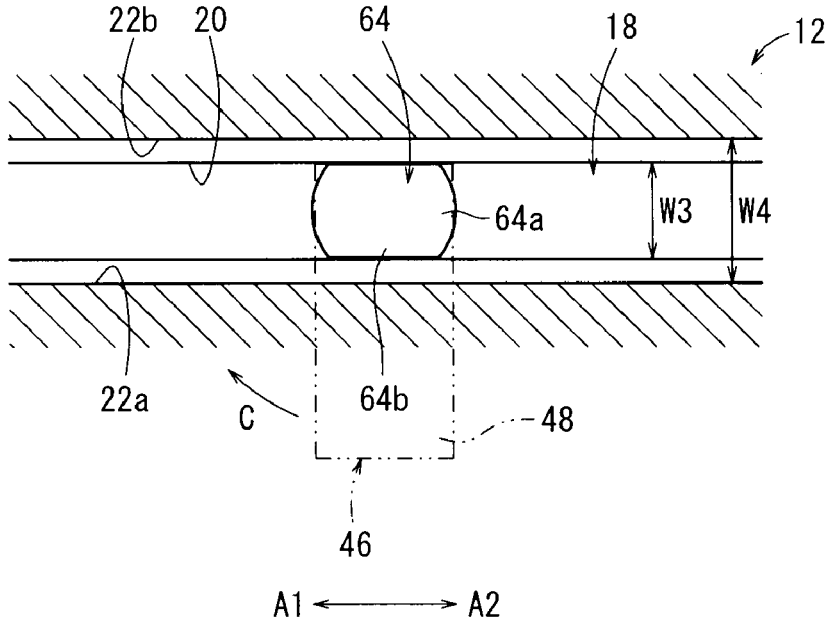
FIG. 7B is a plan view of the holder of FIG. 7A as viewed from a side of the sensor mounting groove.
Figure 8A:
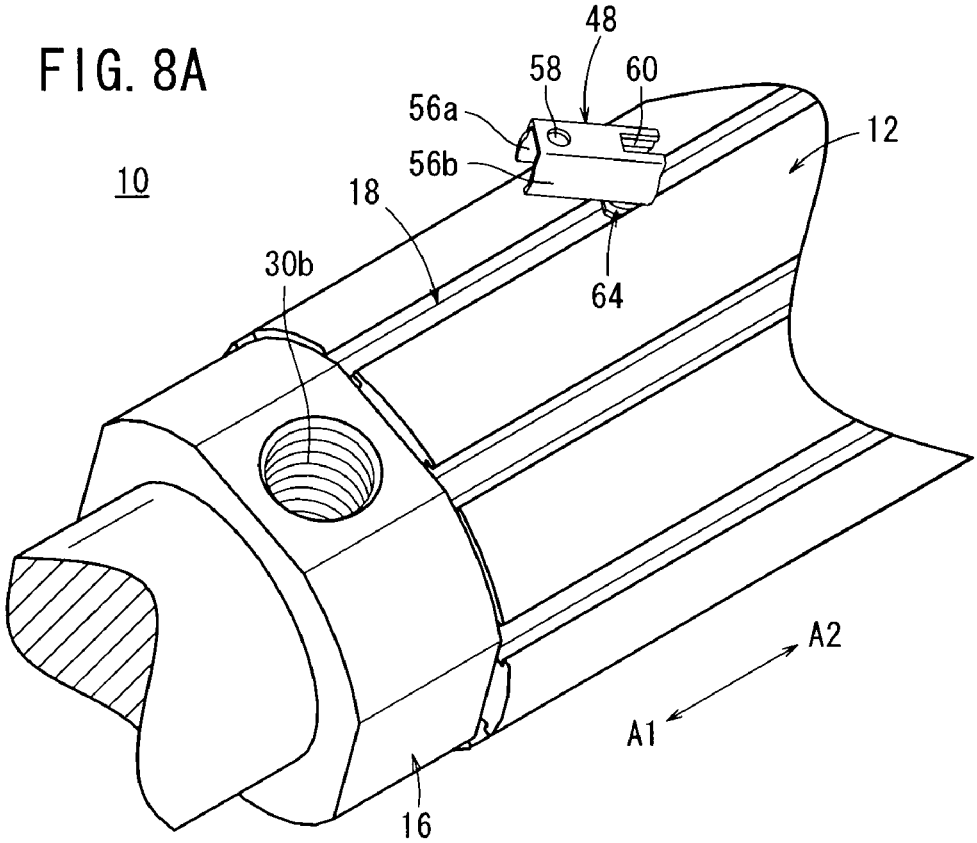
FIG. 8A is an enlarged perspective view of a state in which the holder of FIG. 7A is rotated through a predetermined angle with respect to the sensor mounting groove.
Figure 8B:
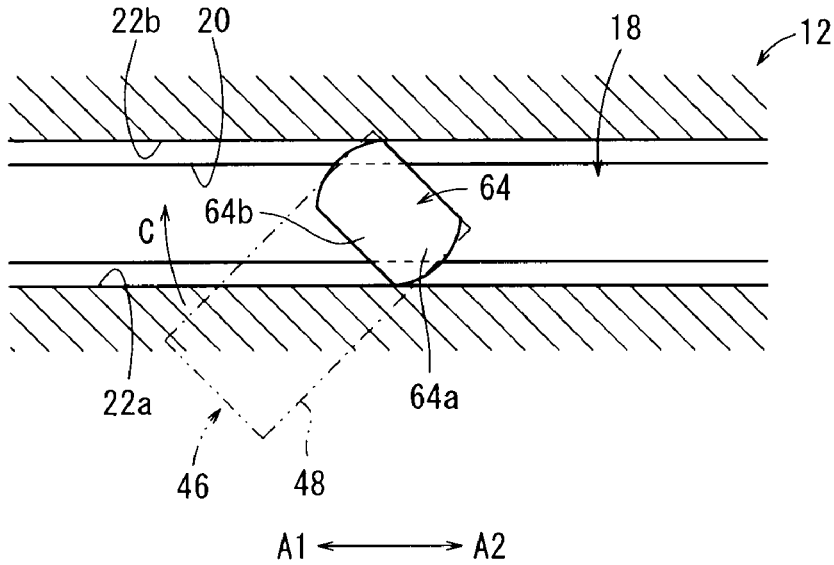
FIG. 8B is a plan view of the holder of FIG. 8A as viewed from a side of the sensor mounting groove.
Figure 9:
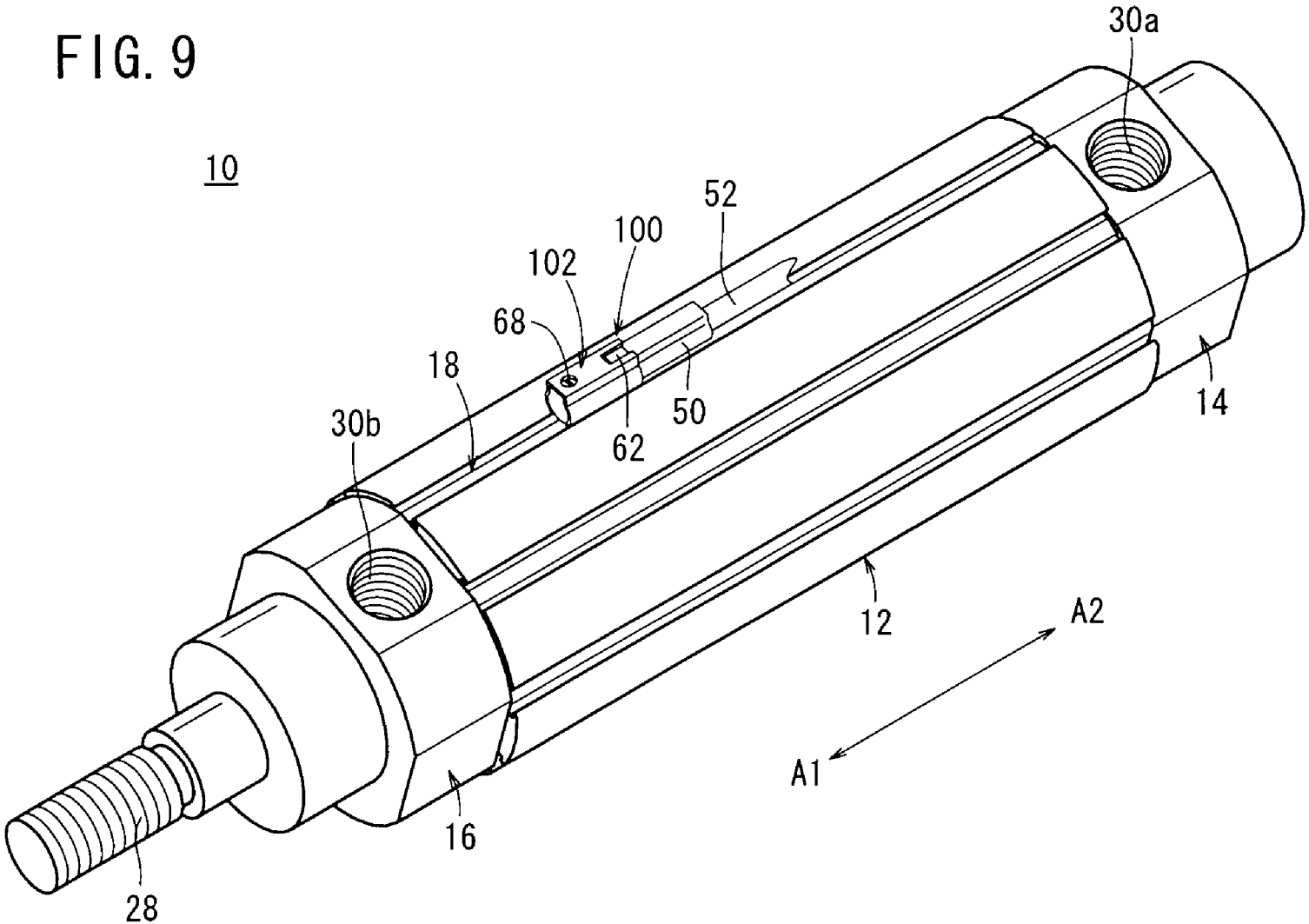
FIG. 9 is an overall perspective view showing a cylinder apparatus on which a position-detecting sensor is installed through application of a mounting mechanism according to a second embodiment of the present invention.
Figure 10:
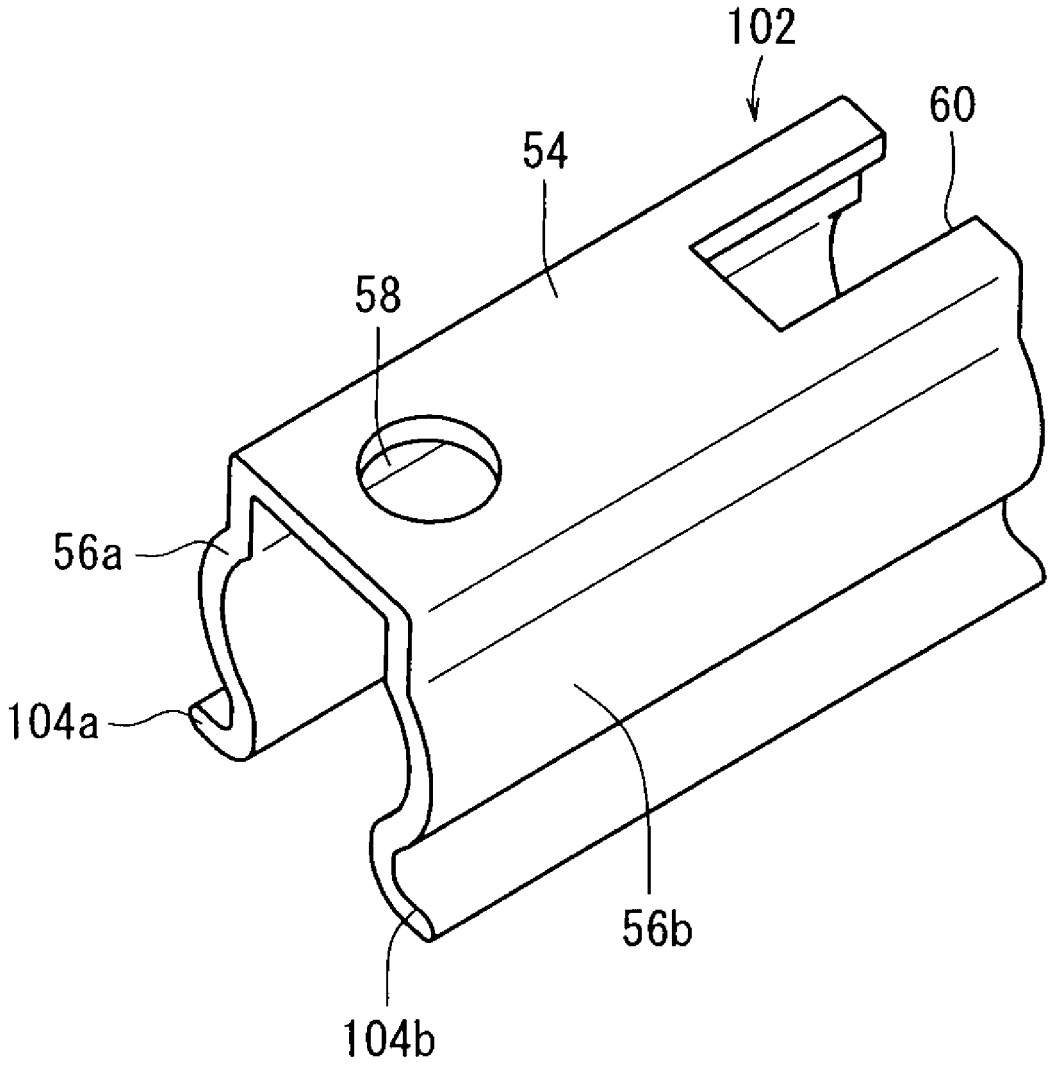
FIG. 10 is a perspective view of a holder making up the position-detecting sensor shown in FIG. 9.

Next, after the holder 48 has been arranged at a desired position in the sensor mounting groove 18, the holder 48 is rotated about the other end on which the flange 64 is disposed (in the direction of the arrow C as shown in FIG. 7B) so that the holder 48 becomes oriented substantially parallel with the extending direction (the direction of arrows A1 and A2) of the sensor mounting groove 18. Specifically, the holder 48 is rotated so that the one end of the holder 48 having the hole 58 approaches the sensor mounting groove 18 and become arranged upwardly of the sensor mounting groove 18. In this case, the flange 64 of the holder 48 is rotated so that the side surfaces of the narrow portion 64*b* with respect to the pair of recess portions 22*a*, 22*b* are rotated gradually from a confronting state (see FIG. 7B) in which the side surfaces are arranged parallel to the recess portions 22*a*, 22*b*, to a direction in which the side surfaces of the narrow portion 64*b* are perpendicular with respect to the recess portions 22*a*, 22*b* (see FIG. 8B). As a result, when the holder 48 is arranged in parallel in an upper portion of the sensor mounting groove 18, the widened portion 64*a* assumes a state of engagement confronting the recess portions 22*a*, 22*b* (see FIG. 4).

Owing thereto, the widened portion 64*a* constituting the flange 64 is engaged with respect to the pair of recess portions 22*a*, 22*b*, respectively, in the sensor mounting groove 18, and moreover, the width dimension W1 of the widened portion 64*a* is set roughly equally with the width dimension W4 of the sensor mounting groove 18 that defines the width dimension between the pair of recess portions 22*a*, 22*b*. Thus, the holder 48 is fixed in the sensor mounting groove 18 via the flange 64, and displacement thereof along the axial direction (the direction of arrows A1 and A2) of the sensor mounting groove 18 is regulated.

Further, at the same time, because the widened portion 64*a* making up the flange 64 is formed to be wider than the opening 20 of the sensor mounting groove 18, the flange 64 and the holder 48 cannot drop or fall out from the sensor mounting groove 18.

Lastly, the sensor element 50 is inserted from the other end side of the holder 48 into the interior of the holder 48, which has been installed in the sensor mounting groove 18, and after the fixing screw 68 of the sensor element 50 has been positioned to confront the hole 58 of the holder 48, the fixing screw 68 is rotated. As a result, the fixing screw 68 abuts against the bottom of the sensor mounting groove 18 and pushes the sensor element 50 upwardly to separate away from the sensor mounting groove 18 (in the direction of the arrow C2).

More specifically, the flange 64 of the holder 48 separates away from the bottom of the sensor mounting groove 18. In this case, the holder 48 also is pressed upwardly by the sensor element 50, which is displaced upwardly, in a direction away from the sensor mounting groove 18 (in the direction of the arrow C2).

In addition, the sensor element 50 moves toward the side of the projecting part 54 inside the holder 48 (in the direction of the arrow C2), and mutual displacement along the axial direction (the direction of arrows A1 and A2), is regulated by contact thereof with the holder 48. Together therewith, because the flange 64 of the holder 48 is latched in engagement against the upper sides of the recess portions 22*a*, 22*b* inside the sensor mounting groove 18, displacement of the holder 48 along the axial direction (the direction of arrows A1 and A2) with respect to the sensor mounting groove 18 also is regulated.

As a result, the position-detecting sensor 46 including the holder 48 is fixed easily and reliably at a desired position in the sensor mounting groove 18 of the cylinder apparatus 10.

In this case, the light-emissive element 62 of the sensor element 50 is arranged at a position facing the cutout 60 of the holder 48.

In the foregoing manner, according to the first embodiment, a holder 48 is provided which retains the sensor element 50 therein, wherein a flange 64 is provided on a lower end portion of the holder 48 confronting the sensor mounting groove 18, which is inserted into the sensor mounting groove 18. The flange 64 includes a widened portion 64*a*, having a width dimension W1 substantially equal to a width dimension W4 defined by the pair of recess portions 22*a*, 22*b* in the sensor mounting groove 18, and a narrow portion 64*b* formed in a narrow shape with respect to the widened portion 64*a* and the opening 20 of the sensor mounting groove 18. The flange 64 is inserted into the sensor mounting groove 18 such that the side surfaces of the narrow portion 64*b* initially are parallel with the sensor mounting groove 18, and the holder 48 is rotated, whereby ends of the widened portion 64*a* are made to engage respectively with the recess portions 22*a*, 22*b*.

Owing thereto, the flange 64 can be inserted easily into the sensor mounting groove 18 via the narrow portion 64*b*, and by rotating the holder 48 together with the flange 64 that has been inserted into the sensor mounting groove 18, the widened portion 64*a* is made to engage with the recess portions 22*a*, 22*b*, enabling a retained condition in which the holder 48 is retained in the sensor mounting groove 18. That is, switching can be performed between a non-retained state and a retained state, in which the holder 48 is retained with respect to the sensor mounting groove 18 by the flange 64 having both the widened portion 64*a* and the narrow portion 64*b*.

As a result, the holder 48 can be easily and securely installed in the sensor mounting groove 18 via the flange 64, and by accommodating and fixing the sensor element 50 inside of the holder 48, the position-detecting sensor 46, including both the holder 48 and the sensor element 50, can be affixed stably and reliably with respect to the sensor mounting groove 18 of the cylinder apparatus 10.

Further, even in the event that the position-detecting sensor 46 is mounted in any arbitrary one of the sensor mounting grooves 18, which are provided in plurality on the cylinder tube 12, the position-detecting sensor 46 including the sensor element 50 therein can be mounted reliably onto the cylinder tube 12 through the holder 48. Furthermore, mounting thereof can be accomplished stably, without changing the relative positional relationship between the cylinder tube 12 and the position-detecting sensor 46. In greater detail, the distance in the radial direction between the magnet 36 of the piston 26, which is arranged inside the cylinder chamber 24 of the cylinder tube 12, and the sensor element 50 (comprising a magnetic sensor) of the position-detecting sensor 46 is kept constant.

As a result, regardless of which of the sensor mounting grooves 18 the position-detecting sensor 46 is installed in, a stable detection result by the sensor element 50 can be obtained, and the displacement position of the piston 26 can be detected with high accuracy by the position-detecting sensor 46.

Furthermore, due to the ends of the widened portion 64*a* making up the flange 64 being arcuate in cross section, when the flange 64 is rotated within the sensor mounting groove 18 and engages with the recess portions 22*a*, 22*b*, the edges of such arcuate shapes are displaced smoothly while in sliding contact with respect to the recess portions 22*a* and 22*b*, thereby facilitating engagement therewith.

Still further, a hole 58, through which a fixing screw 68 is inserted in order to affix the holder 48 with respect to the sensor mounting groove 18 of the cylinder tube 12, is provided on one end of the holder 48, and the flange 64 is disposed on another end side of the holder 48 at a predetermined interval separation from the hole 58. Owing thereto, one end side of the holder 48 can be affixed reliably with respect to the sensor mounting groove 18 by the fixing screw 68, whereas the other end side of the holder 48 is fixed reliably with respect to the sensor mounting groove 18 by the flange 64. As a result, the position-detecting sensor 46 including the holder 48 can be mounted securely and stably with respect to the sensor mounting groove 18.

Stated otherwise, because the flange 64 and the hole 58 are disposed on the holder 48 while being separated by a predetermined distance along the longitudinal direction of the holder 48, displacement of the holder 48 in a rotational direction within the sensor mounting groove 18 is regulated, and looseness or rattling of the holder 48 can be prevented.

Next, a position-detecting sensor 100, to which a mounting mechanism according to a second embodiment of the invention is applied, is shown in FIGS. 9 to 13. Structural elements thereof, which are the same as those of the position-detecting sensor 46 according to the first embodiment, are designated by the same reference numerals, and detailed explanations of such features shall be omitted.

The position-detecting sensor 100 according to the second embodiment differs from the position-detecting sensor 46 according to the first embodiment in that a holder 102 thereof, which retains the sensor element 50 therein, is not equipped with the flange 64 that is inserted into the sensor mounting groove 18, but rather, the holder 102 is formed from a material having a certain resiliency, the bulging portions 56*a*, 56*b* thereof being capable of being deformed so as to be tilted about the projecting part 54.

The holder 102 constituting the position-detecting sensor 100 is formed from a metallic material or a resilient resin material, and includes a projecting part 54 formed with a U-shape in cross section, a pair of arcuate shaped bulging portions 56*a*, 56*b* that are joined to both sides of the projecting part 54, and a pair of a flanges (engagement sections) 104*a*, 104*b*, extending in directions that separate mutually from each other, and which are joined respectively to the bulging portions 56*a*, 56*b*.

Stated otherwise, the pair of bulging portions 56*a*, 56*b* are joined with respect to the downward opening region of the projecting part 54, expanding outwardly in arcuate shapes, joining sections 106*a*, 106*b* are provided, which are separated by a fixed interval on the ends of the bulging portions 56*a*, 56*b*, and the pair of flanges 104*a*, 104*b*, which expand in directions separated mutually from each other, are formed on ends of the joining sections 106*a*, 106*b*.

The pair of flanges 104*a*, 104*b* are adjoined to the joining sections 106*a*, 106*b*, which extend in a vertical direction from ends of the pair of bulging portions 56*a*, 56*b*, and are expanded in width, in a widthwise direction perpendicular with respect to the joining sections 106*a*, 106*b*.

Figure 11:
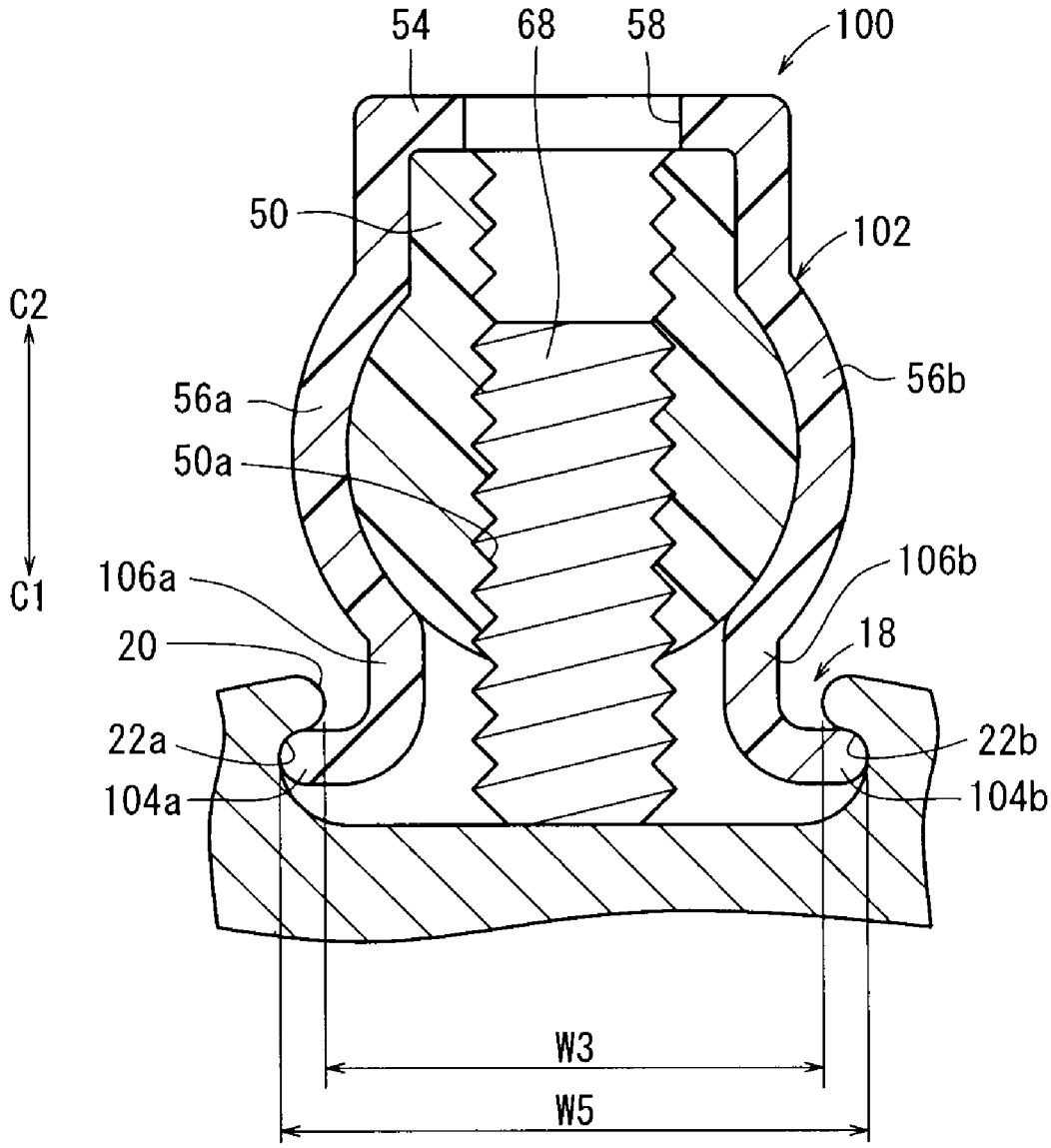
FIG. 11 is a vertical cross sectional view showing a condition in which the position-detecting sensor is installed in a sensor mounting groove of the cylinder apparatus of FIG. 9.
Figure 12:
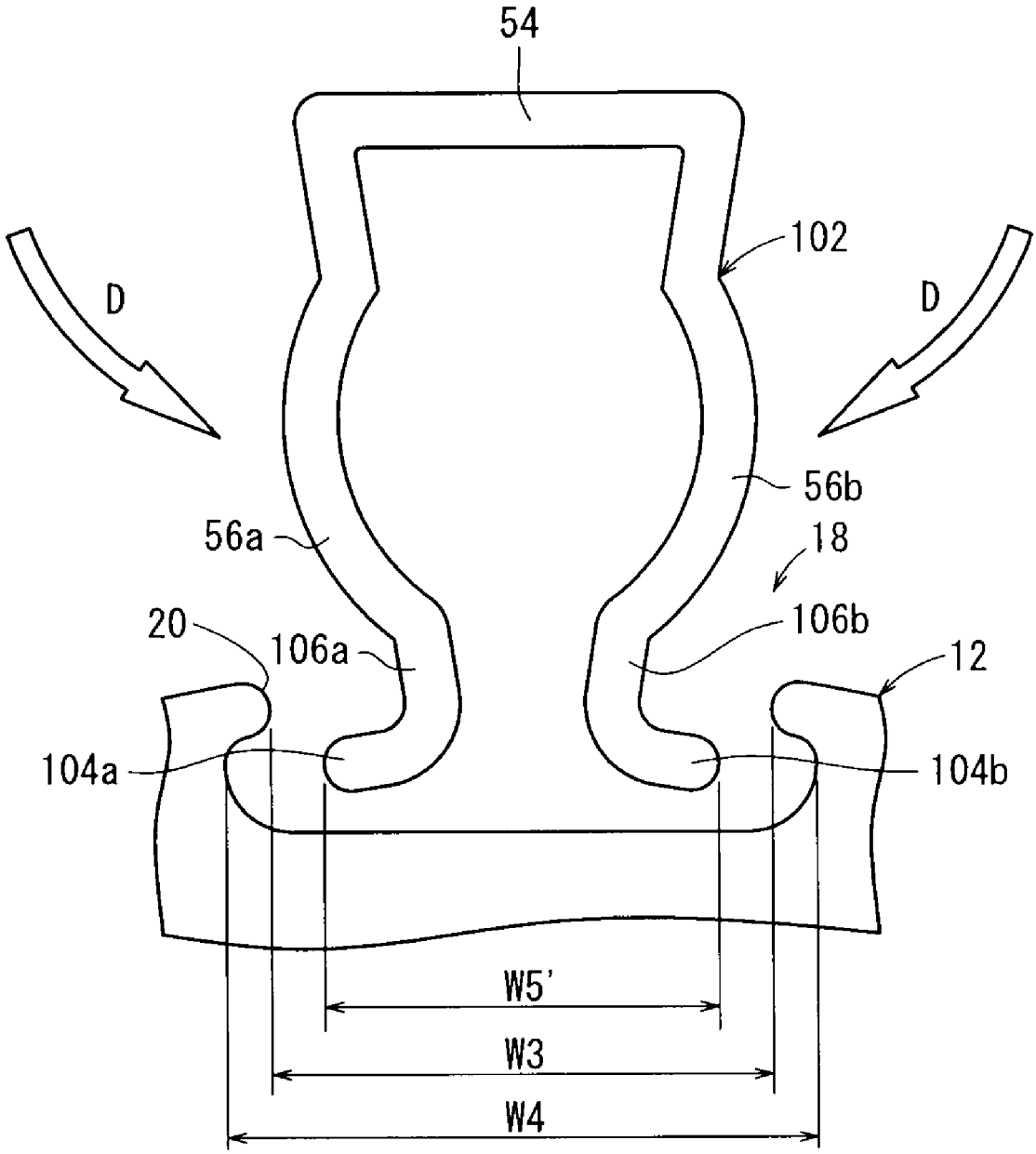
FIG. 12 is an enlarged front view showing a state in which bulging portions are pressed to deform the holder when the position-detecting sensor is installed on the cylinder apparatus.
Figure 13:
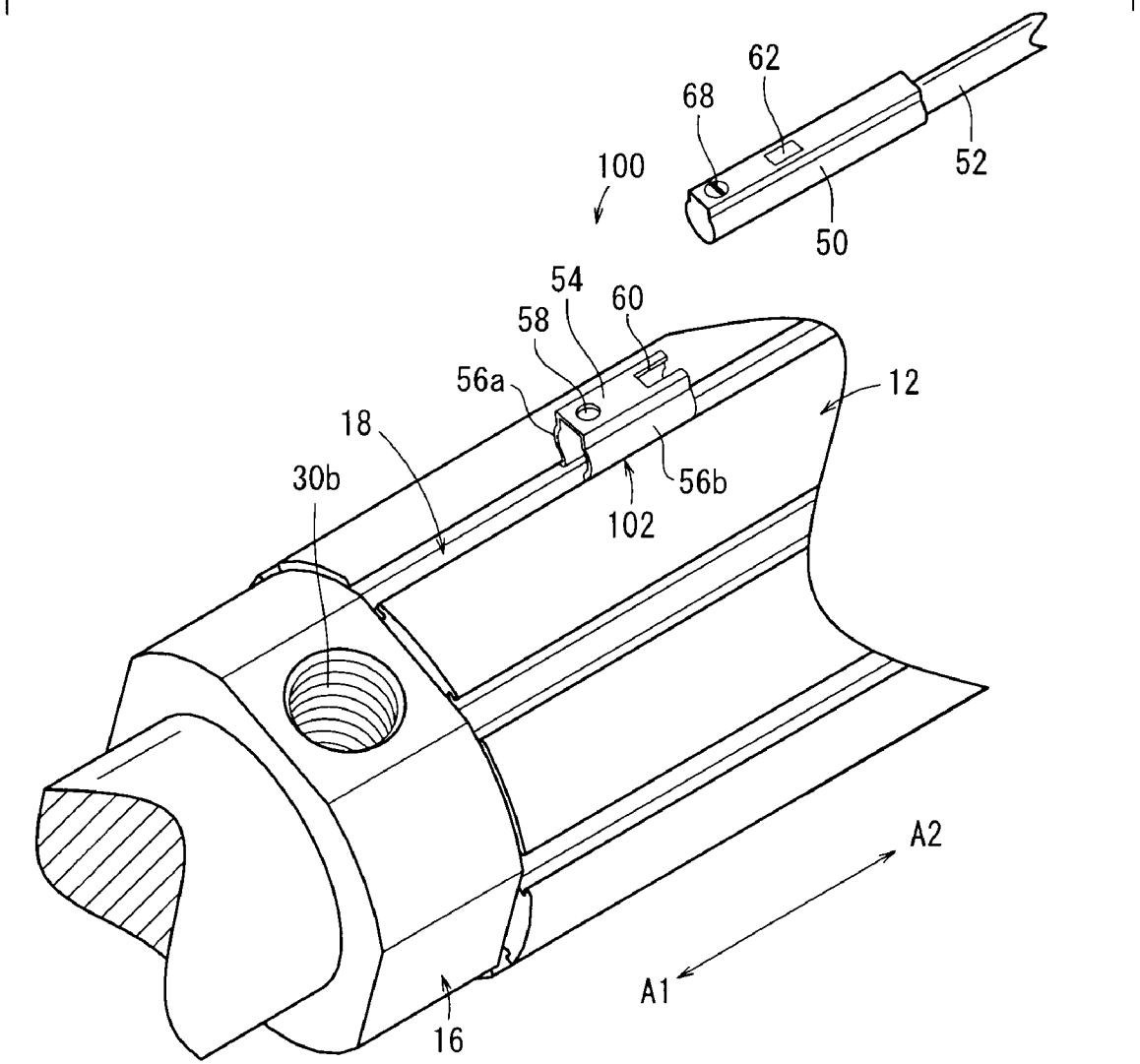
FIG. 13 is an enlarged perspective view showing a state in which the deformed holder of FIG. 12 is installed with respect to the sensor mounting groove.

As shown in FIG. 11, the width dimension W5 of the pair of flanges 104*a*, 104*b* is set substantially equal to the width dimension W4 of the sensor mounting groove 18, defined as the width dimension between the one recess portion 22*a* and the other recess portion 22*b* thereof. The holder 102 is retained within the sensor mounting groove 18 through engagement of each of the pair of flanges 104*a*, 104*b* with respect to the recess portions 22*a*, 22*b*.

Further, while the holder 102 is opened from the side of the projecting part 54 toward the side having the flanges 104*a*, 104*b*, by pressing the pair of bulging portions 56*a*, 56*b* and the flanges 104*a*, 104*b* in directions to approach mutually toward one another (in the direction of the arrows D shown in FIG. 12), the bulging portions 56*a*, 56*b* and the joining sections 106*a*, 106*b* are tilted in the vicinity of the adjoining regions between a ceiling portion of the projecting part 54 and the bulging portions 56*a*, 56*b*. Specifically, the holder 102 is capable of being deformed under application of an external force thereto, and the holder 102 has an elastic force that is capable of restoring the holder 102 to its original shape prior to being deformed in the case that such an external force is not applied.

The sensor element 50, which is formed corresponding to the interior shape of the holder 102, is installed inside the holder 102.

Next, an explanation shall be given in which the position-detecting sensor 100, including the holder 102 having elasticity as described above, is mounted with respect to a sensor mounting groove 18 of the cylinder apparatus 10. In the event that mounting of the position-detecting sensor 100 with respect to the sensor mounting groove 18 of the cylinder apparatus 10 is carried out, initially, a condition is set up in which the sensor element 50 and the holder 102 constituting the position-detecting sensor 100 are separated from each other beforehand.

At first, in a state in which the sensor element 50 is not inserted inside the holder 102, an operator (not shown) grips the holder 102 and presses and deforms the holder 102 in a direction (i.e., the direction of the arrows D in FIG. 12) such that the pair of bulging portions 56*a*, 56*b* or the flanges 104*a*, 104*b* approach mutually toward each other. Accordingly, the pair of flanges 104*a*, 104*b* are tiltably displaced in directions (the direction of the arrows D) to approach mutually toward each other about the adjoining regions between the projecting part 54 and the bulging portions 56*a*, 56*b*, whereby the width dimension between one of the flanges 104*a* and the other of the flanges 104*b* temporarily becomes smaller (as shown by the width dimension W5' in FIG. 12).

In addition, after the holder 102 has been deformed until the width dimension W5 of the pair of flanges 104*a*, 104*b* is made smaller than the width dimension W3 of the opening 20 in the sensor mounting groove 18 (the width dimension W5'), the flanges 104*a*, 104*b* are inserted through the opening 20 into the sensor mounting groove 18. Thereafter, the holder 102 is installed at a desired position in the sensor mounting groove 18 suitable for detecting the position of the piston 26 in the cylinder apparatus 10.

Next, after the flanges 104*a*, 104*b* have been inserted into the sensor mounting groove 18, by releasing the pressure applied with respect to the holder 102, the flanges 104*a*, 104*b* and the bulging portions 56*a*, 56*b* are deformed in a direction to separate from one another under the elasticity of the holder 102, thereby restoring the holder 102 to its original shape prior to being deformed. Owing thereto, the width dimension W5' of the pair of flanges 104*a*, 104*b* returns to its original size (the width dimension W5), becoming substantially the same as that of the preset dimension W4 of the sensor mounting groove 18. As a result, the pair of flanges 104*a*, 104*b* engage respectively with the pair of recess portions 22*a*, 22*b* in the sensor mounting groove 18, and along therewith, the holder 102 having the flanges 104*a*, 104*b* is affixed with respect to the sensor mounting groove 18. In this case, deformation of the holder 102 is completely released, and the holder 102 is restored perfectly to its original shape prior to being deformed. Moreover, the joining sections 106*a*, 106*b* thereof are inserted through the opening 20 of the sensor mounting groove 18.

Lastly, the sensor element 50 is inserted into the interior of the holder 102, which has been installed in the sensor mounting groove 18, and the fixing screw 68 of the sensor element 50 is arranged to confront the hole 58 of the holder 102. Thereafter, by screw-rotating the fixing screw 68, the fixing screw 68 abuts against the bottom of the sensor mounting groove 18 and pushes the sensor element 50 upwardly to separate away from the sensor mounting groove 18 (in the direction of the arrow C2). In this case, the holder 102 also is pressed upwardly together with the upwardly displaced sensor element 50, in a direction away from the sensor mounting groove 18 (in the direction of the arrow C2).

Accordingly, the sensor element 50 moves toward the side of the projecting part 54 inside the holder 102 (in the direction of the arrow C2), and relative displacement along the axial direction (the direction of arrows A1 and A2), is regulated by contact thereof with the holder 102. Further, because the flanges 104*a*, 104*b* of the holder 102 are latched in engagement against the upper sides of the recess portions 22*a*, 22*b* inside the sensor mounting groove 18, displacement of the holder 102 along the axial direction (the direction of arrows A1 and A2) with respect to the sensor mounting groove 18 also is regulated.

As a result, the position-detecting sensor 100 including the holder 102 is fixed easily and reliably at a desired position in the sensor mounting groove 18 of the cylinder apparatus 10. In this case, the light-emissive element 62 of the sensor element 50 is arranged at a position facing the cutout 60 of the holder 102.

In this manner, with the position-detecting sensor 100, to which a mounting mechanism according to the above-described second embodiment is applied, a holder 102 formed of a resin material having a certain elasticity is capable of being deformed, so that by temporarily deforming the holder 102 and installing the holder 102 in the sensor mounting groove 18, installation of the position-detecting sensor 100 including the holder 102 with respect to the sensor mounting groove 18 can be swiftly and easily carried out. Further, since the structure of the position-detecting sensor 100 including the holder 102 can be simplified, costs for the position-detecting sensor 100 can be reduced.

The position-detecting sensor according to the present invention is not limited to the above-described embodiments, and various modified and/or additional structures may be adopted as a matter of course, which do not deviate from the essence and gist of the present invention.

What is claimed is:

1. A mounting mechanism for mounting a position-detecting sensor on an actuator, comprising:

an elongated groove provided in a side surface of the actuator, the groove having a groove opening and a recess portion having a width wider than the width of the groove opening; and an elongated sensor holder for accommodating said sensor therein, said sensor holder having a first portion, and a second portion spaced from said first portion in the direction of elongation of the sensor holder, said sensor holder further comprising:

an engagement section non-rotatably mounted at said first portion, said engagement section comprising a plate having a first width in the direction of elongation of the sensor holder that is smaller than the width of the groove opening, and a second width transverse to the direction of elongation of the sensor holder that is substantially equal to the width of the recess portion, whereby said engagement section can be introduced into said groove through said groove opening with said plate oriented so that the first width aligns with the width of the groove opening and the direction of elongation of the sensor holder is transverse to the direction of elongation of the groove, and whereby the plate is retained in the groove upon rotation of the sensor holder with the plate in the groove such that the second width aligns with the width of the recess portion and the direction of elongation of the sensor holder is parallel to the direction of elongation of the groove, and a threaded element at said second portion, the threaded element being adjustable for engaging said groove, when said plate is in the groove such that the second width aligns with the width of the recess portion and the direction of elongation of the sensor holder is parallel to the direction of elongation of the groove, to prevent further rotation of the sensor holder and to fix the position of the sensor holder along the length of the groove.

2. The mounting mechanism according to claim 1, wherein said threaded element is a fixing screw, further comprising a hole in said holder through which said fixing screw is inserted.

3. The mounting mechanism according to claim 1, wherein said actuator comprises:

a cylindrically shaped cylinder tube on which said groove is disposed along an outer circumferential surface thereof, and having a cylinder chamber disposed thereinside to which a pressure fluid is supplied; and a piston disposed displaceably along said cylinder chamber.

4. The mounting mechanism according to claim 1, wherein ends of the plate having the second width are arcuate.

* * * * *